United States Patent [19]

Kohama et al.

[11] 4,434,767

[45] Mar. 6, 1984

[54] OUTPUT CONTROL SYSTEM FOR MULTICYLINDER INTERNAL COMBUSTION ENGINE

[75] Inventors: Tokio Kohama, Nishio; Seizi Huzino; Hideki Obayashi, both of Okazaki; Hisasi Kawai, Toyohashi; Tsuneyuki Egami, Aichi, all of Japan

[73] Assignee: Nippon Soken, Inc., Nishio, Japan

[21] Appl. No.: 333,781

[22] Filed: Dec. 23, 1981

[30] Foreign Application Priority Data

Dec. 24, 1980 [JP] Japan ..... 55-183058

[51] Int. Cl.³ ..... F02D 17/02

[52] U.S. Cl. ..... 123/481; 123/198 F

[58] Field of Search ..... 123/481, 198 F, 587

[56] References Cited

U.S. PATENT DOCUMENTS 3,270,724 9/1966 Dolza ..... 123/198 F 4,080,947 3/1978 Iizuka ..... 123/481

4,144,864 3/1979 Kato et al. ..... 123/481

4,207,856 6/1980 Sugasawa et al. ..... 123/481

4,237,838 12/1980 Kinugawa et al. ..... 123/587

FOREIGN PATENT DOCUMENTS 54-55232 5/1979 Japan ..... 123/481

*Primary Examiner*—Parshotam S. Lall

*Attorney, Agent, or Firm*—Cushman, Darby & Cushman

[57] ABSTRACT

In the range where the fuel efficiency may be improved by relatively increasing the load of working cylinders at the time of partial loading of a multicylinder internal combustion engine, the intake pressure of the engine is maintained at a fixed optimum value. Also, the number of working cylinders is controlled, so that a torque actually required by the driver is obtained, and under any load, the maximum improvement of fuel efficiency may be attained at a saving of fuel consumption.

6 Claims, 10 Drawing Figures

FIG. 10

NUMBER OF WORKING CYLINDERS = 6.00

| ADDRESS | CYLINDER NO. | | | | | |
|---|---|---|---|---|---|---|
| | 1 | 5 | 3 | 6 | 2 | 4 |
| 1920 | H | H | H | H | H | H |
| 1921 | H | H | H | H | H | H |
| 1922 | H | H | H | H | H | H |
| 1923 | H | H | H | H | H | H |
| 1924 | H | H | H | H | H | H |
| 1925 | H | H | H | H | H | H |
| 1926 | H | H | H | H | H | H |
| 1927 | H | H | H | H | H | H |
| 1928 | H | H | H | H | H | H |
| 1929 | H | H | H | H | H | H |
| 1930 | H | H | H | H | H | H |
| 1931 | H | H | H | H | H | H |
| 1932 | H | H | H | H | H | H |
| 1933 | H | H | H | H | H | H |
| 1934 | H | H | H | H | H | H |
| 1935 | H | H | H | H | H | H |
| 1936 | H | H | H | H | H | H |
| 1937 | H | H | H | H | H | H |
| 1938 | H | H | H | H | H | H |
| 1939 | H | H | H | H | H | H |

$Q_0$ $Q_1$ $Q_2$ $Q_3$ $Q_4$ $Q_5$

CYLINDER SELECTION DATA Sc

NUMBER OF WORKING CYLINDERS = 5.80

| ADDRESS | CYLINDER NO. | | | | | |
|---|---|---|---|---|---|---|
| | 1 | 5 | 3 | 6 | 2 | 4 |
| 1792 | L | H | H | H | H | H |
| 1793 | H | H | H | H | H | H |
| 1794 | H | H | H | H | H | H |
| 1795 | H | H | H | H | H | H |
| 1796 | H | H | H | H | H | H |
| 1797 | L | H | H | H | H | H |
| 1798 | H | H | H | H | H | H |
| 1799 | H | H | H | H | H | H |
| 1800 | H | H | H | H | H | H |
| 1801 | H | H | H | H | H | H |
| 1802 | L | H | H | H | H | H |
| 1803 | H | H | H | H | H | H |
| 1804 | H | H | H | H | H | H |
| 1805 | H | H | H | H | H | H |
| 1806 | H | H | H | H | H | H |
| 1807 | L | H | H | H | H | H |
| 1808 | H | H | H | H | H | H |
| 1809 | H | H | H | H | H | H |
| 1810 | H | H | H | H | H | H |
| 1811 | H | H | H | H | H | H |

NUMBER OF WORKING CYLINDERS = 4.50

| ADDRESS | CYLINDER NO. | | | | | |
|---|---|---|---|---|---|---|
| | 1 | 5 | 3 | 6 | 2 | 4 |
| 960 | L | H | H | H | L | H |
| 961 | H | H | L | H | H | H |
| 962 | L | H | H | H | L | H |
| 963 | H | H | L | H | H | H |
| 964 | L | H | H | H | L | H |
| 965 | H | H | L | H | H | H |
| 966 | L | H | H | H | H | H |
| 967 | L | H | L | H | H | H |
| 968 | L | H | H | H | L | H |
| 969 | H | H | L | H | H | H |
| 970 | L | H | H | H | L | H |
| 971 | H | H | L | H | H | H |
| 972 | L | H | H | H | L | H |
| 973 | H | H | L | H | H | H |
| 974 | L | H | H | H | L | H |
| 975 | H | H | L | H | H | H |
| 976 | L | H | H | H | L | H |
| 977 | H | H | L | H | H | H |
| 978 | L | H | H | H | L | H |
| 979 | H | H | L | H | H | H |

NUMBER OF WORKING CYLINDERS = 3.00

| ADDRESS | CYLINDER NO. | | | | | |
|---|---|---|---|---|---|---|
| | 1 | 5 | 3 | 6 | 2 | 4 |
| 0 | L | H | L | H | L | H |
| 1 | L | H | L | H | L | H |
| 2 | L | H | L | H | L | H |
| 3 | L | H | L | H | L | H |
| 4 | L | H | L | H | L | H |
| 5 | L | H | L | H | L | H |
| 6 | L | H | L | H | L | H |
| 7 | L | H | L | H | L | H |
| 8 | L | H | L | H | L | H |
| 9 | L | H | L | H | L | H |
| 10 | L | H | L | H | L | H |
| 11 | L | H | L | H | L | H |
| 12 | L | H | L | H | L | H |
| 13 | L | H | L | H | L | H |
| 14 | L | H | L | H | L | H |
| 15 | L | H | L | H | L | H |
| 16 | L | H | L | H | L | H |
| 17 | L | H | L | H | L | H |
| 18 | L | H | L | H | L | H |
| 19 | L | H | L | H | L | H |

H : WORKING L : IDLE

OUTPUT CONTROL SYSTEM FOR MULTICYLINDER INTERNAL COMBUSTION ENGINE

FIELD OF THE INVENTION

The present invention relates to an output control system for a multicylinder internal combustion engine, or more in particular to an output control system in which the pressure of the intake pipe is maintained constant and the fuel is supplied intermittently thereby to effect the operation of partial cylinders under a partial load of the engine.

The background of the present invention and preferred embodiments of the present invention will be described below with reference to the accompanying drawings.

BRIEF DESCRIPTION OF THE DRAWINGS

FIG. 10 is a diagram showing an example of the data in the memory circuit included in the number-of-cylinders control circuit of FIG. 5.

DESCRIPTION OF THE PRIOR ART

For facilitating the understanding of the present invention, the prior art of the present invention will be described below.

Figure 1:
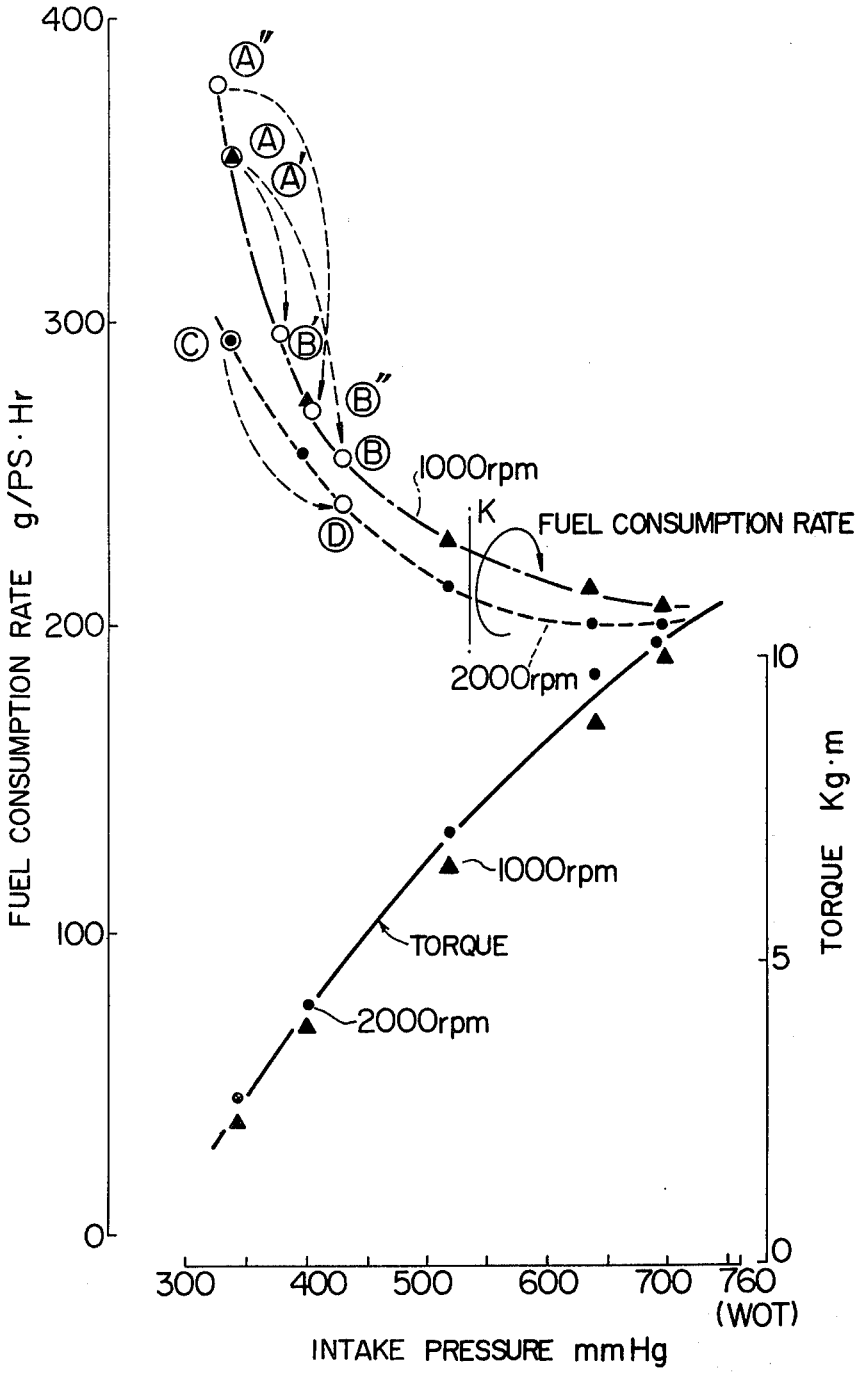
FIG. 1 is a diagram showing the relation between the pressure of the intake pipe and the fuel consumption for explaining the operations of the prior art and the present invention.

A graph showing the relation between the pressure of the intake pipe, fuel consumption and torque is shown in FIG. 1. In FIG. 1, when the internal combustion engine is operated at high load, the fuel consumption rate tends to improve. In view of this, an internal combustion engine with the number-of-cylinders control system is well known in which at a small load thereof, fuel supply to part of the multiple cylinders is stopped thereby to suspend the operation thereof, while increasing the load on the other working cylinders relatively, so that the fuel efficiency of the internal combustion engine as a whole is improved.

In the case where a 6-cylinder engine is run with only three cylinders thereof working under a small load as shown in FIG. 1, for instance, the engine can be operated with low fuel consumption as point Ⓐ changes to Ⓑ at the engine speed of 1000 rpm and from Ⓒ to Ⓓ at the engine speed of 2000 rpm.

In the above-mentioned case where the 6-cylinder engine is operated with only three cylinders thereof working, the conventional control system is such that as shown in FIG. 1, the fuel consumption changes from Ⓐ to Ⓑ for the engine speed of 1000 rpm, while the fuel consumption changes from Ⓐ to Ⓑ′ in the case of only four cylinders working. This shows a considerable difference in the result of partial engine operation depending on the number of working cylinders involved.

In running an internal combustion engine, the ultimate aim is to secure a certain degree of torque. When an excessive torque is produced by the three-cylinder operation, therefore, the engine is driven at point Ⓑ″ by closing the throttle valve in a manner to reduce the load. In the case of six-cylinder operation, the engine is driven at point Ⓐ′. When compared with the operation at (B), the effect is larger at Ⓑ″ than at Ⓐ′ for the three-cylinder operation although the difference is not significant.

As described above, the conventional systems are such that the effect of the control of the number of working cylinders varies according to the load conditions.

Further, according to the conventional systems, in changing from 6-cylinder operation to 5-cylinder operation, 4-cylinder operation or 3-cylinder operation, or from any of the latter to the former, smooth transfer of the points in-between is difficult.

SUMMARY OF THE INVENTION

The object of the present invention is to provide an output control system for the multicylinder internal combustion engine in which, in the range where the fuel efficiency can be improved, the pressure of the intake pipe is kept constant by relatively increasing the load of the working cylinders at the time of partial loading of the internal combustion engine and the torque actually required by the driver is obtained by controlling the number of working cylinders, thus attaining the maximum fuel efficiency under any load.

DESCRIPTION OF THE PREFERRED EMBODIMENTS

An output control system for the multicylinder internal combustion engine according to the present invention will be described in detail below with reference to an embodiment.

Figure 2:
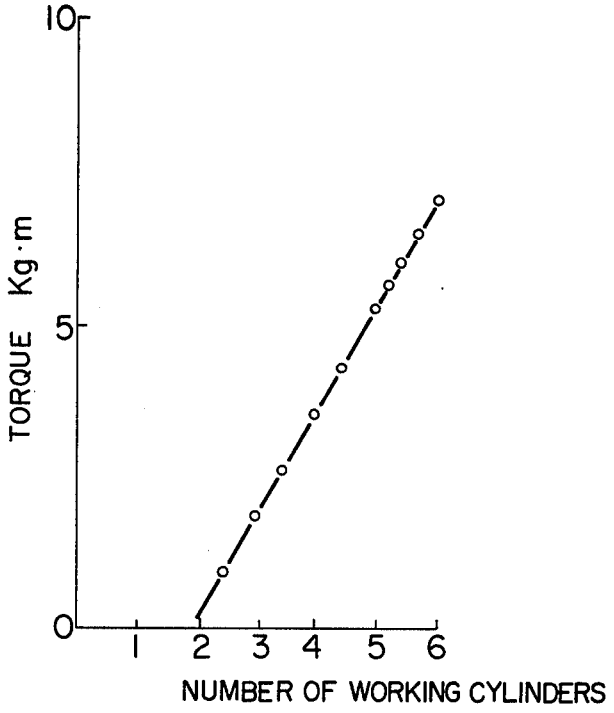
FIG. 2 is a diagram showing the relation between the number of working cylinders and the torque.

A graph showing the relation between the number of working cylinders and the torque for explaining the operation of the present invention is illustrated in FIG. 2.

By increasing relatively the load of the working cylinders at the time of partial loading of the internal combustion engine, it is necessary to control the pressure of the intake pipe at a constant level all the time in the range where the fuel efficiency may be improved. In other words, a point K must be set in FIG. 1.

As shown in FIG. 2, the relation between the number of working cylinders and the torque is linear in the case of a six-cylinder engine. In FIG. 2, the desired torque may be obtained for other than an integral number of working cylinders by controlling the engine operation in such a manner that 11 out of 12 combustion cycles are combusted for the 5.5-cylinder operation, 23 out of 24 combustion cycles are combusted for the 5.75-cylinder operation, 9 out of 12 combustion cycles are combusted for the 4.5-cylinder operation and so forth. For example, 5.75-cylinder operation means that the six cylinders of the engine burn twenty-three times and stop one time during twenty-four combustion cycles. That is, twenty-four cycles means that all but one of the cylinders perform four combustion cycles, and that one specific cylinder only performs three combustion cycles. Therefore, the meaning of 5.75 cylinders is that all of five cylinders burn (5) and the remaining one cylinder burns 3 out of 4 times (0.75). Accordingly $5+0.075=5.75$ cylinder.

In driving the internal combustion engine, on the other hand, the final required torque for driving the vehicle by the driver's operation of the throttle is important.

According to the present invention, under the load where the fuel efficiency may be improved, the pressure of the intake pipe is maintained at a constant level and the number of the working cylinders is controlled thereby to produce a torque actually required by the driver.

As shown in FIG. 2, the number of working cylinders and the torque are linearly related to each other. In FIG. 2, 23 out of 24 combustion cycles are combusted for the 5.75-cylinder operation, 11 out of 12 combustion cycles are combusted for the 5.5-cylinder operation, 3 out of 4 combustion cycles are combusted for the 4.5-cylinder operation and so forth. In this way, the number of combustion cycles is controlled for other than an integral number of working cylinders, thus producing the desired torque.

As seen from the above description, the system according to the present invention is such that in the load range where the fuel efficiency may be improved, the pressure of the intake pipe is maintained at an optimum constant level and the number of the working cylinders is controlled, so that the load on the working cylinders is increased relatively. In this way, the engine is run at high combustion efficiency thereby to improve the fuel efficiency.

Figure 3:
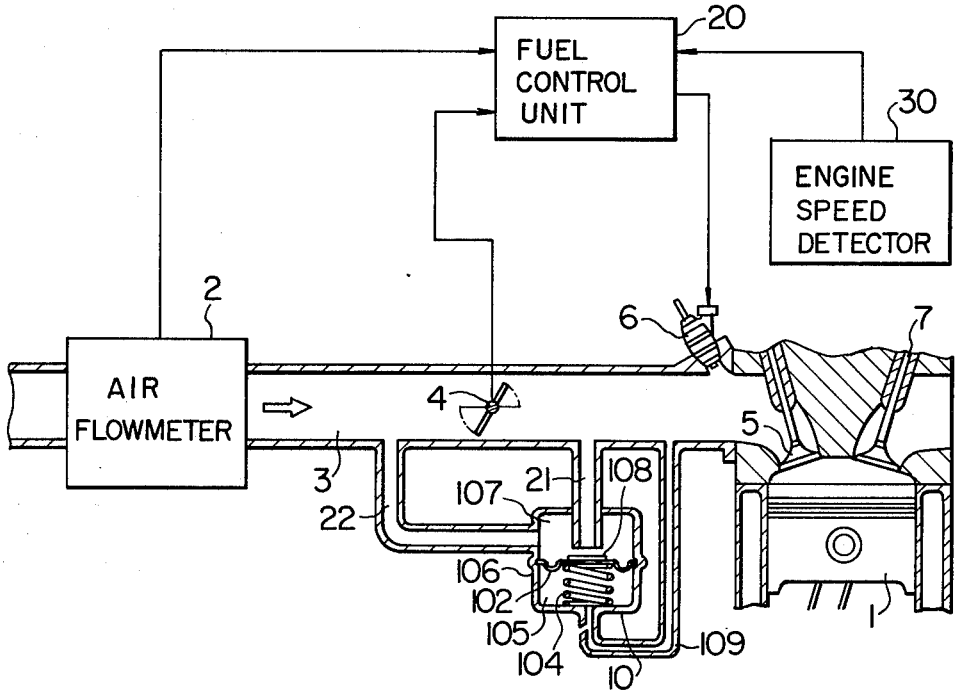
FIG. 3 is a diagram showing the construction of an embodiment of the output control system for the internal combustion engine according to the present invention.

The construction of an embodiment of the output control system for the multicylinder internal combustion engine according to the present invention is shown in FIG. 3. In FIG. 3, the internal combustion engine 1 is of spark ignition type for driving the automobile and is adapted to be supplied with the combusting air through an air cleaner not shown, an air flowmeter 2, an intake pipe 3, a throttle valve 4 and an intake valve 5. The fuel is supplied by injection from electromagnetic fuel injectors 6 mounted on the intake pipe 3.

Figure 4:
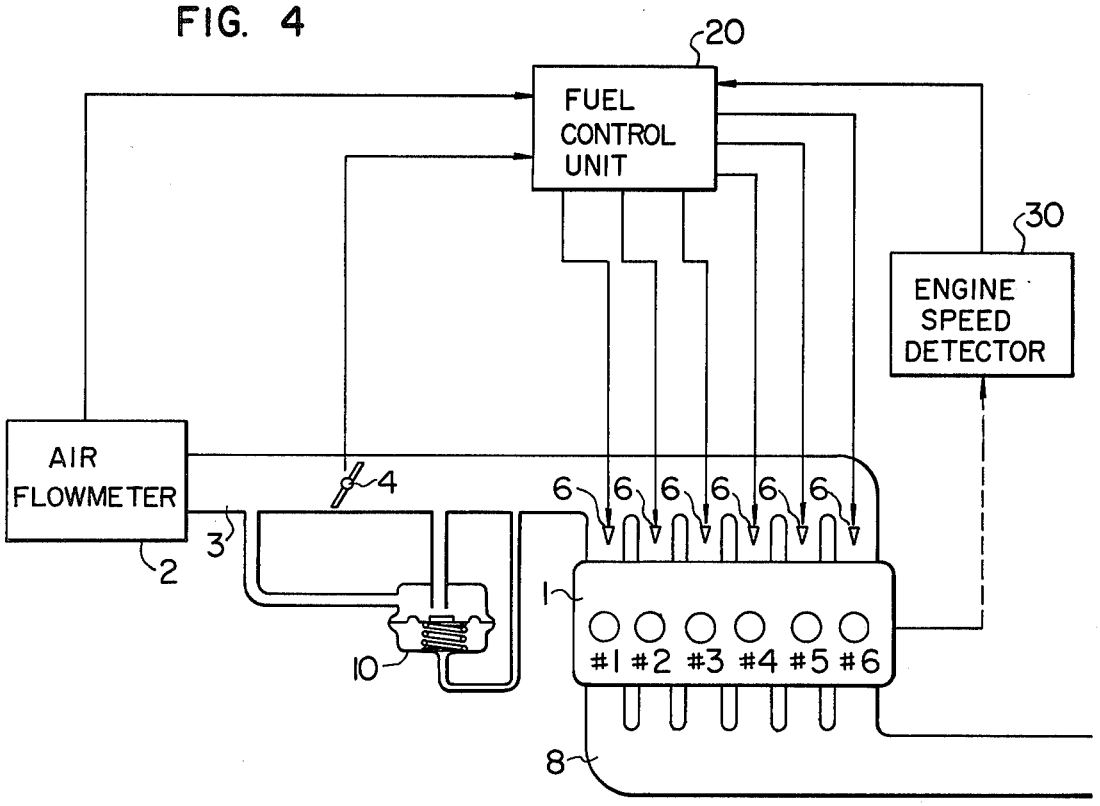
FIG. 4 is a diagram related to the output control system for the internal combustion engine according to the present invention shown in FIG. 3.

FIG. 4 shows a diagram related to FIG. 3 showing the output control system for the multicylinder internal combustion engine according to the present invention. The fuel injector 6 is mounted on each of the cylinders as shown in FIG. 4. The intake pipe 3 is provided with the throttle valve 4 operated as desired by the vehicle driver. The air-fuel mixture combusted in the internal combustion engine 1 is discharged into the atmosphere as an exhaust gas through the exhaust valve 7 and an exhaust tube 8.

Numeral 10 designates a constant-pressure valve making up a second control means for controlling the intake pressure downstream of the throttle valve 4 at a constant level. This constant pressure valve 10 includes a housing 106 and a diaphragm 102 disposed in the housing 106 for forming two chambers 105 and 107.

The first chamber 105 composed of the housing 106 and one side of the diaphragm 102 is supplied with the intake pipe pressure from downstream of the throttle valve 4 through the pressure conduction tube 109. The chamber 105 contains a spring 104 for pressing the diaphragm 102. The second pressure chamber 107 formed by the housing 106 and the other side of the diaphragm 102 is connected with an end of the first pipe 21 with the other end thereof opened to the intake pipe downstream of the throttle valve 4 and an end of the second pipe 22 with the other end thereof opened to the intake pipe upstream of the throttle valve 4. Numeral 108 designates a valve seat integrated with the diaphragm 102. By controlling the opening of the first pipe 21 to the valve seat 108, the amount of the air which bypasses the throttle valve 4 through the first pipe 21 and the second pipe 22 and which is supplied downstream of the throttle valve 4 is controlled.

Numeral 30 designates an engine speed detector for detecting the engine speed of the internal combustion engine 1, which engine speed detector uses an ignition signal for the ignition coil according to the present embodiment.

Numeral 20 designates a fuel control unit making up first control means, which is supplied with the detection signals of the air flowmeter 2 and the engine speed detector 30 of the throttle valve 4. In response to these signals, the opening operation and the time of opening of the fuel injector 6, are controlled by a microcomputer.

Figure 5:
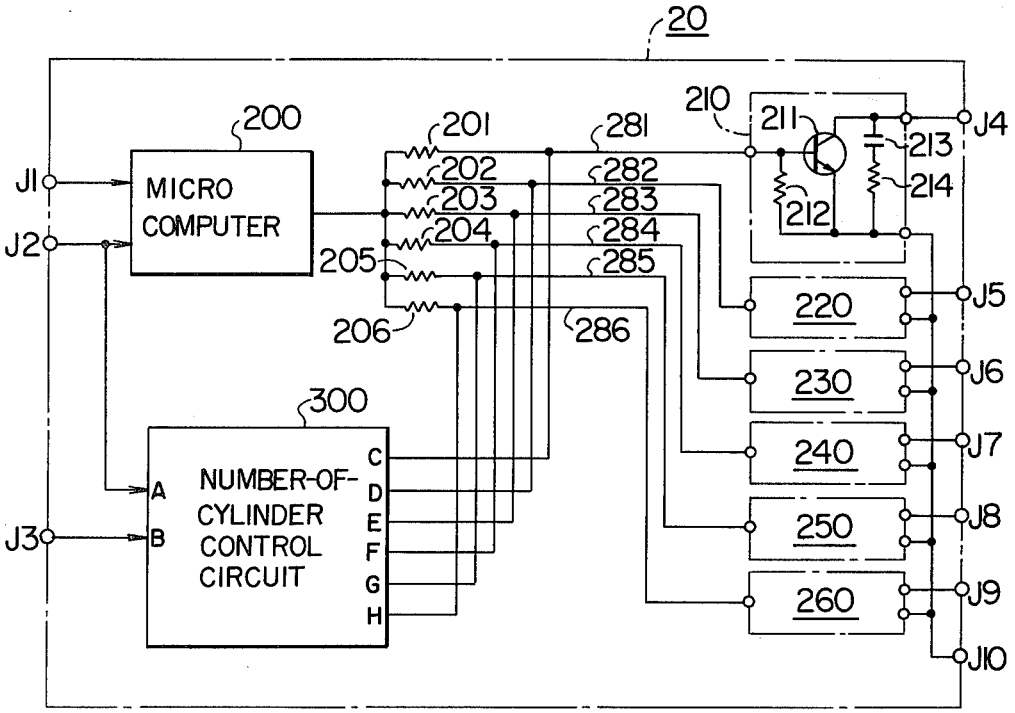
FIG. 5 shows the construction of a fuel control unit in the circuit of FIG. 4.
Figure 6:
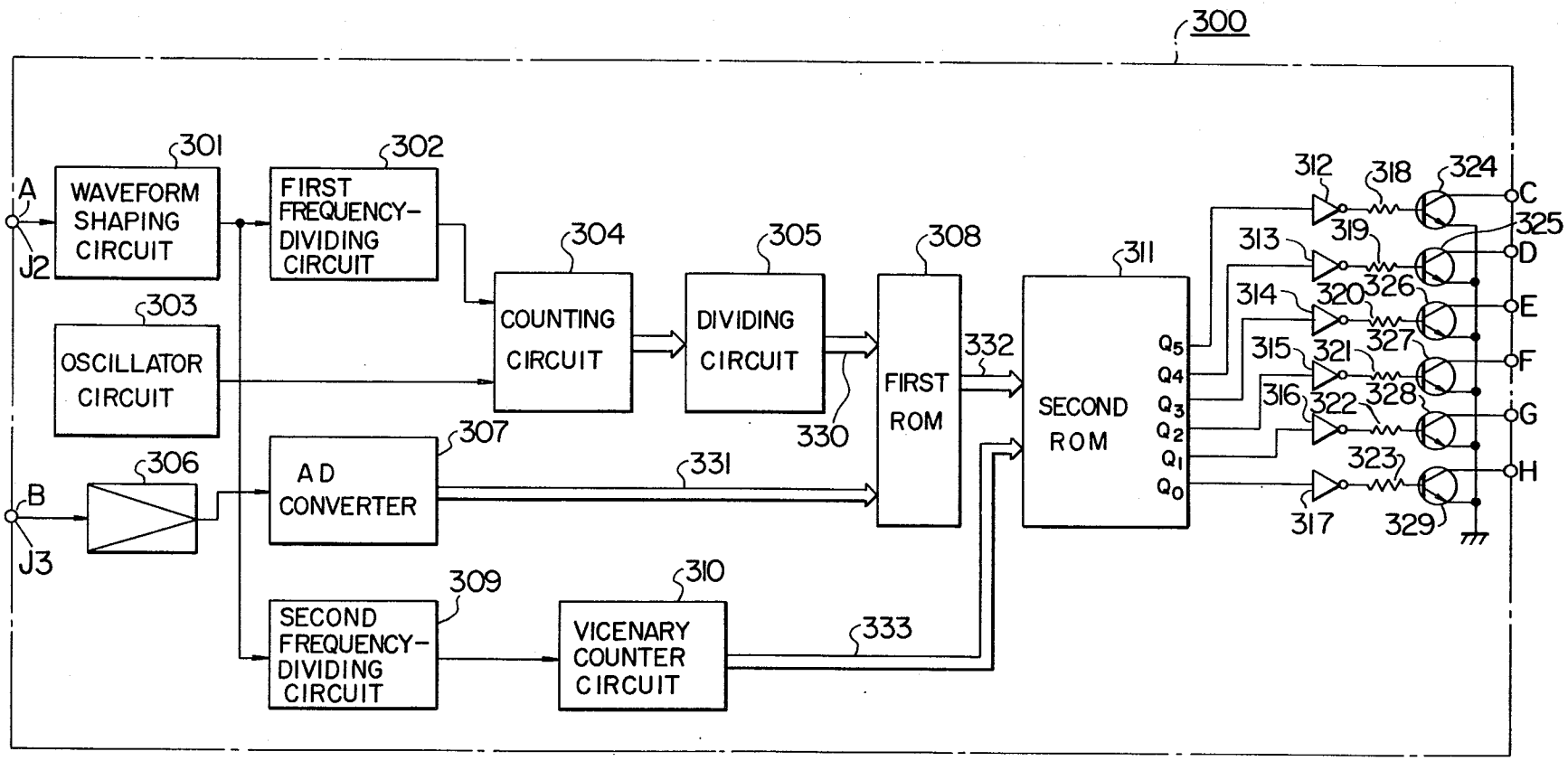
FIG. 6 is a diagram showing the construction of a number-of-cylinders control circuit in FIG. 5.
Figure 7:
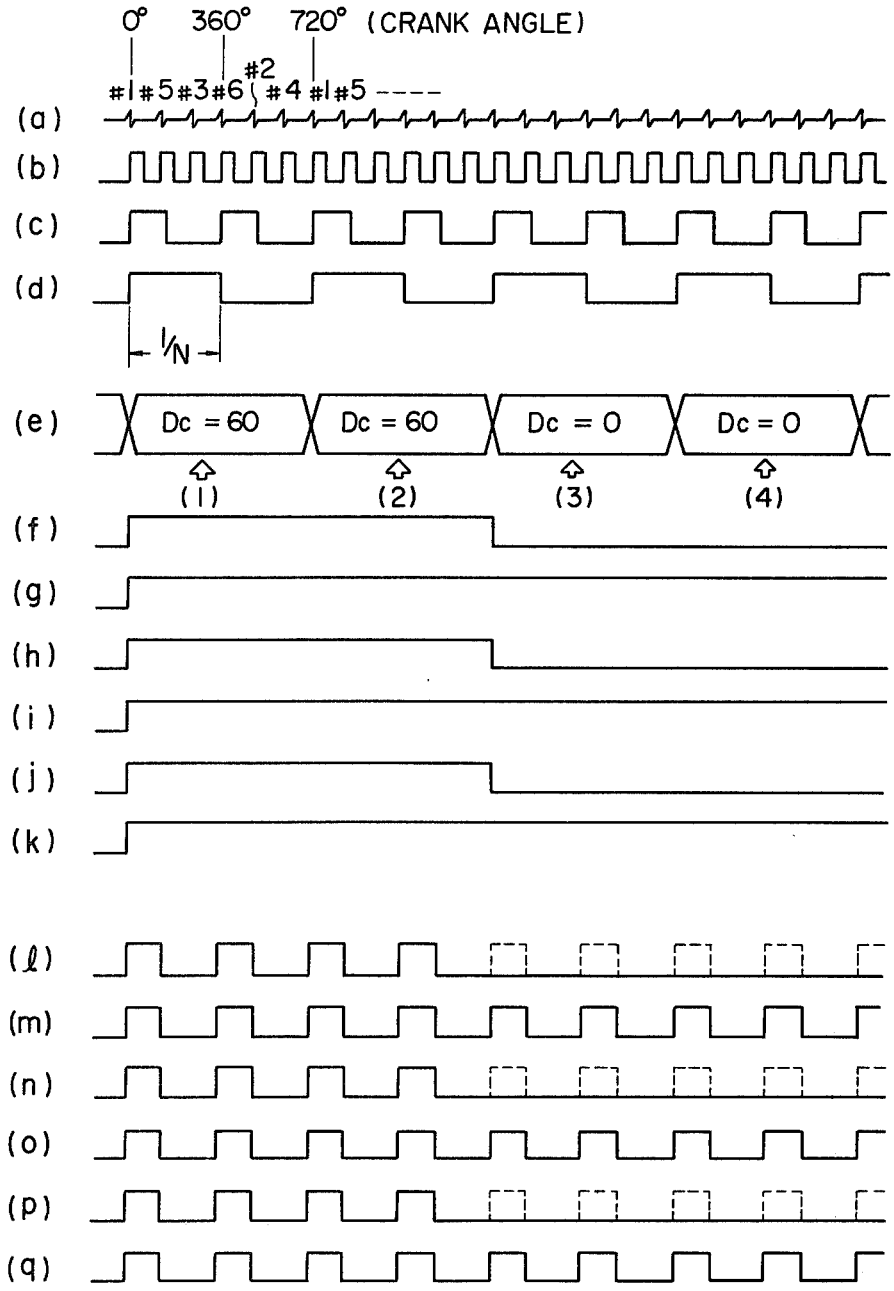
FIG. 7 shows operating waveforms for the fuel control unit.

The construction of the fuel control unit 20 of FIG. 4 is shown in FIG. 5, the construction of the number-of-cylinders control circuit 300 of FIG. 5 is shown in FIG. 6, and the operation waveform of the fuel control unit 20 is shown in FIG. 7.

The construction of the fuel control unit 20 shown in FIG. 3 will be described with reference to FIGS. 5 and 6. In FIG. 5, reference numeral 200 designates a well-known micro computer. With an air amount signal and an ignition signal in synchronism with the engine crank rotation applied by way of the terminals J1 and J2 respectively, a valve open signal for the fuel injector is produced. Numeral 210 designates a power switch circuit for actuating the injector, which switch comprises a power transistor 211, a base-grounded resistor 212, a capacitor 213 and a resistor 214.

Numerals 220, 230, 240, 250 and 260 show power switch circuits of the same circuit configuration as the power switch 210 for independently driving the injector 6 of the engine cylinders in cooperation with the power switch circuit 210.

Resistors 201, 202, 203, 204, 205 and 206, with an end thereof connected in common to the outputs of the micro-computer, have the other ends thereof connected to the power switch circuits 210, 220, 230, 240, 250 and 260 through the connecting lines 280–286 respectively. In FIG. 6, numeral 300 designates a number-of-cylinders control circuit which is supplied with the ignition signal at the terminal J2 in FIG. 5 and the throttle opening signal at the terminal J3 through the input terminals A and B respectively to determine the number of working cylinders thus subjecting the connecting lines 281, 282, 283, 284, 285 and 286 to on-off control by way of the output terminals C, D, E, . . . , and H respectively. In this way, the fuel injection at each cylinder is actuated or non-actuated thereby to control the number of working cylinders. The terminals J4, J5, J6, J7, J8 and J9 shown in FIG. 5 are connected to the injector 6, respectively provided on the cylinders. The terminal J10 shown in FIG. 5 is a power-grounding terminal.

A detailed configuration of the number-of-cylinder control circuit 300 will be explained with reference to FIG. 6. Numeral 301 designates a waveform-shaping circuit for shaping the ignition signal applied by way of the input terminal into a pulse signal. Numeral 302 shows a first frequency-dividing circuit for frequency-dividing the output signal of the waveform-shaping circuit 301 and producing a pulse signal having a period corresponding to the time equivalent to two revolutions of the engine crank shaft. Numeral 303 designates an oscillator circuit including a crystal oscillator for generating a clock signal of a predetermined frequency. Numeral 304 designates a counting circuit for counting the pulse width of the signal produced from the frequency-dividing circuit 302 by use of the clock signal of the oscillator circuit 303. Numeral 305 designates a dividing circuit for converting the count in the counter circuit 304 into the reciprocal thereof and producing the data on the engine speed in the form of a 7-bit binary number. Numeral 306 designates an amplifier circuit using an operational amplifier which amplifies the throttle opening signal of the throttle valve 4 shown in FIG. 3 supplied at the input terminal B. Numeral 307 designates an analog-digital converter (hereinafter referred to as the AD converter) for converting the output signal of the amplifier circuit 306 into a digital signal and producing it as a 6-bit binary number. Numeral 308 designates a well-known first read-only memory (hereinafter referred to the first ROM) in which the output value is programmed beforehand for an input. This first ROM has 6 bits for a word and a program capacity of 8K words. Each address of the first ROM 308 is comprised of 13 bits, of which the most significant 7 bits are such that the output signal of the dividing circuit 307 is connected through the connecting line 330. For the remaining less significant 6 bits, the output of the AD converter 307 is connected through the connecting line 331. Numeral 309 designates a second frequency-dividing circuit for frequency-dividing the output signal of the waveform-shaping circuit 301 and producing a pulse for each two revolutions of the engine crank shaft. Numeral 310 designates a vicenary counting circuit for continuously counting the output signal of the frequency-dividing circuit 309 and producing a count in the form of a binary number of five bits. Numeral 311 designates a second ROM of the same construction as the first ROM 308. The second ROM 311 comprises 6 bits for a word and has a program capacity of 2K words. Each address of this second ROM 311 has 11 bits, of which the most significant 6 bits is such that the output of the first ROM 308 is connected through the connecting line 332, and for the less significant five bits, the output of the vicenary counting circuit 310 is connected through the connecting line 333. Numerals 312, 313, 314, 315, 316 and 317 designate inverters for inverting the output of the memory circuit 311. The resistors 318, 319, 320, 321, 322 and 323 are base resistors for the transistors 324, 325, 326, 327, 328 and 329 respectively. The transistors 324, 325, 326, 327, 328 and 329 are subjected to on-off control by the inverters 312, 313, 314, 315, 316 and 317 respectively, and the collectors thereof are connected to the output terminals C–H, of the number-of-cylinders control circuit 300 respectively.

In the aforementioned construction, the operation of the output control system for the multicylinder internal combustion engine according to the present invention will be described below.

A certain amount of air determined by the opening of the throttle valve 4 is introduced from the air cleaner through the air flowmeter 2, the intake pipe 3 and the intake valve 5 into the internal combustion engine 1. The pressure of the intake pipe generated downstream of the throttle valve 4 is imparted through the pressure conduction tube 109 to the first chamber 105. The force downward in FIG. 3 caused by the intake manifold pressure downstream of the throttle valve 4 introduced to the first pressure chamber 105 and the repulsive force thereto by the spring 104 are exerted on the diaphragm 102. In the case where, of the forces acting on the diaphragm 102, the pulling force of the intake pressure is largest, the opening comprised of the valve seat mounted on the diaphragm 102 and the first pipe 21 increases, so that the amount of air introduced downstream of the throttle valve 4 bypassing the throttle valve 4 through the second pipe 22 and the first pipe 21 increases, thus causing the intake pressure downstream of the throttle valve 4 to approach the atmospheric pressure.

As a result, the intake pressure acting on the diaphragm 102 also approaches the atmospheric pressure, with the result that the repulsive force of the spring 104 becomes larger. The diaphragm 102 moves upward in FIG. 3, so that the opening formed by the valve seat 108 and the first pipe 21 is reduced, and the amount of air introduced downstream of the throttle valve 4 bypassing the throttle valve 4 through the first pipe 21 and the second pipe 22 is reduced, thus rendering the intake pressure negative downstream of the throttle valve 4.

In this way, the intake pressure downstream of the throttle valve 4 is controlled at a predetermined value depending on the area of the diaphragm 102 and the force of the spring. In the case where the intake pressure downstream of the throttle valve 4 is smaller than the predetermined value (namely, near to the atmospheric pressure), the constant-pressure valve 10 fails to operate and the valve seat 108 and the first pipe are left closed. If the setting of the constant-pressure valve 10 is a fixed value between 400 and 760 mmHg of the intake pressure, a great improvement in fuel efficiency is achieved.

Figure 8:
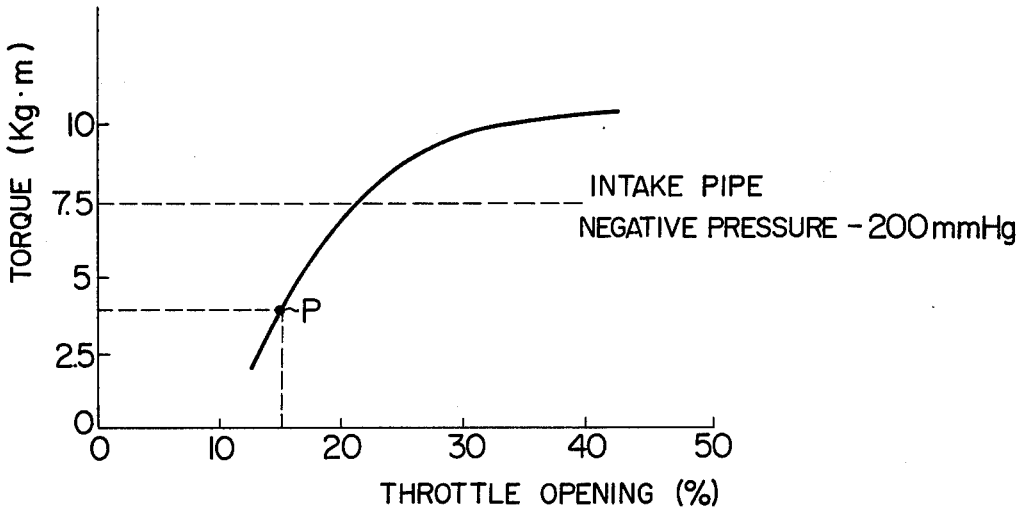
FIGS. 8 and 9 are diagrams showing the relation between the throttle opening of the output control system and the axial torque according to the present invention.

The relation between the throttle opening and the torque of a 6-cylinder 2000 cc engine at the engine speed of 2000 rpm according to the present invention is shown in the characteristic diagram of FIG. 8. The relation between the throttle opening and the torque under the constant pressure control of a minus 200 mmHg in intake pressure in the state of FIG. 8 is shown in the characteristic diagram of FIG. 9. An example of the data in the memory circuit provided in the number-of-cylinders control circuit of FIG. 5 is shown in FIG. 10.

Now, the operation of the fuel control unit 20 will be explained with reference to FIGS. 7 to 10.

The terminals J1 and J2 of the fuel control unit 20 are supplied with a signal representing the air amount measured at the air flowmeter 2 and an ignition signal detected from the ignition coil 30 shown at (a) of FIG. 7 respectively. It is well known that the opening signal of the injection valve is calculated by the micro computer 200 to produce the signal as shown at (c) of FIG. 7.

The ignition signal applied to the input terminal J2 of the fuel control unit 20, on the other hand, is applied to the input terminal A of the number-of-cylinders control circuit 300. This signal is shaped by the waveform shaping circuit 301 and transformed into the pulse signal as shown at (b) of FIG. 7. This signal is frequency-divided to 1/6 by the frequency divider circuit 302, so that one period of the signal at (d) of FIG. 7 corresponds to the crank angle of 720 degrees and the pulse width is proportional to the reciprocal of the engine speed N. This pulse width is counted at the counter circuit 304 by use of a clock signal of a predetermined frequency produced from the oscillator circuit 303. As a result, the count n of the counter circuit 304 takes the value as shown in the equation below.

$$n = K_1 \cdot \frac{1}{N} \quad (1)$$

($K_1$: constant)

With this count n as a divisor and with the dividend as a constant, division is made by the dividing circuit 305, thus producing the result m as expressed by the equation below.

$$m = K_2 \cdot N \quad (2)$$

($K_2$:proportionality constant)

Assume that by appropriately selecting the frequency of the clock signal of the oscillator circuit 303, the proportionality constant $K_2$ of equation (2) is made variable and the output data m of the divider circuit 305 takes a value of 127 (7 bits in binary notation) at the engine speed N of 6000 rpm. The resolution of the output of the divider circuit 305 is about 47 rpm.

The throttle opening signal of the throttle valve 4 applied to the input terminal J3 of the fuel control unit 20 is applied to the number-of-cylinders control circuit 300, and amplified to an appropriate voltage by the amplifier circuit 306. The output of the amplifier circuit 306 is converted into a digital value by the AD converter 307. By appropriately selecting the gain of the amplifier circuit 306, the converted value TH takes values from 0 to 63 (6 bits in binary number) in decimal number in the throttle opening range from the closed-up state to full-open state. If the AD conversion is effected every two revolutions of the crankshaft, the calculation of the engine speed is effected at intervals of as many revolutions of the crankshaft. Therefore, the amount determined by the throttle opening TH and the parameter of the engine speed N which is an output of the dividing circuit 305 changes every two revolutions of the crankshaft. If the number of engine working cylinders based on these two parameters is stored in the memory circuit 308, therefore, the output data of the memory circuit 308 undergoes a change every two revolutions of the crankshaft as shown at (e) of FIG. 7.

Figure 9:
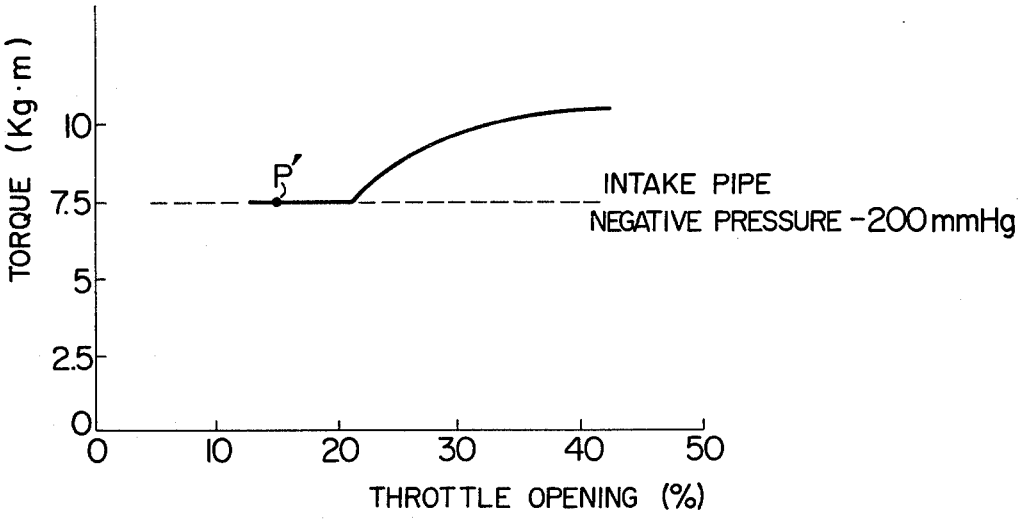

The data Dc on the number of working cylinders stored in the memory circuit 308 are determined from the characteristics of FIGS. 8 and 9. FIG. 8 shows a graph of the well-known relation between the throttle opening and the axial torque of the 6-cylinder 2000 cc engine, and specifically refers to the characteristics for the engine speed of 2000 rpm.

The diagram of FIG. 9 shows a characteristic obtained when the same engine is subjected to a constant pressure control to −200 mmHg in the negative pressure (560 mmHg in the pressure) of the intake pipe.

In the engine state represented by the point P in FIG. 8, the throttle opening is 15% and the torque is 4 kg.m. If the negative pressure of the intake pipe is controlled to the constant level of −200 mmHg by the constant pressure valve, the state of point P' in FIG. 9 is attained. Under this condition, the torque is 7.5 kg.m. Thus for the purpose of attaining the torque of point P in FIG. 8 using the constant pressure valve, the number of working cylinders is reduced to meet the object of the present invention. The relation between the number of working cylinders and the torque is plotted under a fixed negative pressure of the intake pipe to obtain the experimental data shown in FIG. 2. In view of this linear relation, the number of cylinders to obtain the torque of point P at point P' may be expressed by the following equation:

$$\text{Number of working cylinders} = \text{Axial torque at point P} \times 6/\text{Torque at point P}' \quad (3)$$

(6 means 6 cylinders)

The resolution of the data Dc on the number of working cylinders stored in the memory circuit 308 is assumed to be 0.05 cylinders and the number of working cylinders is 3 for the data Dc of zero. Then the equation below is obtained.

$$Dc = (\text{Number of working cylinders} - 3)/0.05 \quad (4)$$

Thus the data on the number of working cylinders at point P' in FIG. 9 as obtained from equations (3) and (4) are:

$$Dc = \{(4 \times 6/7.5) - 3\}/0.05 = 4.00$$

The binary number "000100" is stored. The data Dc on the number of working cylinders are 0 to 60 in binary number which is 6 bits in binary system when the resolution is 0.05 cylinders in the range from 3 to 6 cylinders.

The method of determining the data Dc on the number of working cylinders is shown above at the engine speed of 2000 rpm and the throttle opening of 15%. In similar manner, similar data may be obtained at other engine speeds and throttle openings. The data Dc on the number of working cylinders are stored in the memory circuit 308.

Now, explanation will be made about the cylinder selection data Sc stored in the memory circuit 311. The cylinder selection data Sc are comprised of 6 bits for a word, and as shown in FIG. 10, the bits $Q_0$ to $Q_5$ correspond to 1, 5, 3, 6, 2 and 4 cylinders respectively of the engine. The cylinder selection data Sc are comprised of 20 addresses depending solely on the number of working cylinders. FIG. 10 specifically shows the case of 6.00, 5.80, 4.50 and 3.00 in the number of working cylinders.

If the number of working cylinders is 5.8, for instance, in the address range from 1792 to 1811, each address corresponds to two revolutions of the engine, so that 20 addresses correspond to 40 revolutions of the crankshaft. If 6 cylinders are worked for 2 revolutions of the crankshaft, 40 revolutions of the crankshaft corresponds to 120 cylinders working and therefore the number of working cylinders is 5.80. From the equation $(120-x)/120 = 5.80/6.00$, the number of suspensions during the working equivalent to 120 cylinders x is determined to be 4. In the case of 5.8 working cylinders in FIG. 10, the first cylinder of the addresses 1792, 1797, 1802 and 1807 is idle.

It will be easily understood that the relation between the number of working cylinders and the number suspensions during 40 revolutions of crankshaft is as shown below.

$$\text{Number of working cylinders} = \frac{120 - \text{Number of suspensions}}{120} \times 6.00 \quad (5)$$

From the relation of equation (5), the number of suspensions for the number of working cylinders of 4.50 at the other addresses in FIG. 10 is 30, so that the cylinder selection data Sc for determining the working or suspension are as shown in FIG. 10. The cylinder selection data for other numbers of working cylinders may be determined in similar manner. These cylinder selection data Sc are stored in the second ROM 311 in advance.

As to the address of the second ROM 311, the significant 6 bits are the output of the first ROM 308, while the less significant 5 bits are the output of the vicenary counter circuit 310 incrementing the count by one for each two revolutions of the crankshaft. Therefore, the output of the first ROM makes up the address of the significant 6 bits of the second ROM. In other words, of the count of the vicenary counter circuit 310 is zero for the number of working cylinders of 6, and the number of addresses of the second ROM 311 is $60 \times 32 + 0 = 1920$, so that the output of the second ROM 311 is "HHHHHH".

If the count of the vicenary counter circuit 310 increases by one, on the other hand, the addresses of the second ROM 311 become 1921, and the output of the second ROM 311 becomes "HHHHHH" representing the full cylinder operation (6 working cylinders). At each two revolutions of the crankshaft, the vicenary counter circuit 310 increments by one sequentially, and when it counts 20, the count becomes zero twice. Therefore, the number of addresses of FIG. 10 changes from 1920 to 1921 to . . . to 1939 to 1920 and so on thereby to repeat the 6-cylinder operation.

Under this condition, the output of the second ROM 311 turns on and off the connecting lines 281, 282, 283, 284, 285 and 286 through the inverter, resistor and the transistor. Thus when the bit of the output of the second ROM 311 is "H", the injector of the cylinder corresponding to the particular bit works, while when the bit of the output of the second ROM 311 is "L", the corresponding injector becomes idle.

The waveforms (f)–(k) shown in FIG. 7 correspond to the bits $Q_0$ to $Q_5$ produced from the second ROM 311. A logical product of this signal and the output signal of the micro computer 200 shown at (c) of FIG. 7 determines the working or suspension of injection. The signals at (1)–(q) of FIG. 7 represent the injection signals for 1, 5, 3, 6, 2 and 4 cylinders respectively.

The portions (1) and (2) at (e) of FIG. 7 represent the 6-cylinder operation, while the portions (3) and (4) at (e) of FIG. 7 represent the 3-cylinder operation.

In the aforementioned embodiment, a 6-cylinder 2000 cc engine is involved. Instead, the present invention may be applied with equal effect to other multicylinder engines of such as 4 or 8 cylinders with the number of bits for 1 word unchanged in the second ROM 311.

Further, although the resolution of 0.05 of the number of working cylinders is involved, the resolution may be improved by increasing the number of bits for one word of the memory circuit 308 thereby to improve the system accuracy.

The cylinder selection data Sc of other combinations has the same effect as long as the equation (5) is satisfied.

It will be understood from the foregoing description that as described above, according to the present invention, in the load range where the fuel efficiency may be improved, the pressure of the intake manifold is maintained at a constant level while at the same time controlling the number of working cylinders, so that the torque required actually by the driver is capable of being obtained easily. As a result, under any load, the maximum improvement of fuel efficiency may be attained all the time.

Further, since the continuous torque control is possible in accordance with the throttle opening, a smooth torque characteristic is obtained, thus preventing any deteriorated operability.

Furthermore, according to the present invention, when a greater torque is required by the driver, namely, when the accelerator pedal is depressed deeply by the driver, the full cylinder operation is always obtainable and therefore the driver does not feel any insufficiency of the driving power.

What is claimed is:

1. An output control system for a multicylinder internal combustion engine having an intake pipe comprising an engine speed detector for detecting the speed of the engine, signal output means for producing a signal corresponding to an output required of the engine, first control means for receiving signals of said engine speed detector and said signal output means, said first control means controlling the number of combinations during predetermined combustion cycles in all cylinders by periodically stopping fuel injection to a specific cylinder to periodically stop the fuel combustion during the cycles in accordance with the signals of said engine speed detector and said signal output means and supplying fuel to the engine intermittently thereby to subject the engine to a partial cylinder operation, and second control means including a constant pressure valve for controlling the pressure in the intake pipe at a constant level at the time of partial load operation of the engine.

2. A system according to claim 1, wherein said signal output means detects the opening position of selected one of the throttle valve of said internal combustion engine and a control valve operatively interlocked with said throttle valve.

3. A system according to claim 1, wherein said first control means includes a fuel control unit controlled by a microcomputer for calculating the fuel supply to each cylinder of said internal combustion engine on the basis of the data stored in advance in accordance with said engine speed detector and said signal output means.

4. A system according to claim 3, wherein said fuel control unit includes an electrically-controlled engine fuel injection system for producing an opening signal for the injection valve in response to an ignition signal, a power switch circuit for driving said injection valve, and a number-of-cylinders control circuit for selected one of actuation and non-actuation of fuel injection for each cylinder and thereby to control the number of working cylinders.

5. A system according to claim 1, wherein said time of partial load operation indicates the time when the pressure in the intake pipe is between 160 mmHg and 660 mmHg.

6. The system according to claim 1, wherein said constant level of the pressure in the intake pipe is constant value between 400 mmHg and 760 mmHg.

* * * * *